United States Patent [19]

Riess et al.

[11] Patent Number: 4,501,551

[45] Date of Patent: Feb. 26, 1985

[54] METHOD FOR PRODUCING A DRIED PARTICULATE COAL FUEL FROM A PARTICULATE LOW RANK COAL

[75] Inventors: Louis P. Riess, Evergreen; Bernard F. Bonnecaze, Littleton, both of Colo.

[73] Assignee: Atlantic Richfield Company, Los Angeles, Calif.

[21] Appl. No.: 550,424

[22] Filed: Nov. 10, 1983

[51] Int. Cl.[3] ..... F27B 15/00; F26B 3/08

[52] U.S. Cl. ..... 432/15; 34/10; 44/6

[58] Field of Search ..... 432/14, 15; 44/1 G, 44/6; 34/10

[56] References Cited

U.S. PATENT DOCUMENTS

| | | | |
|---|---|---|---|
| 1,886,633 | 11/1932 | Broeman | 44/6 |
| 2,098,232 | 11/1937 | Fife | 44/6 |
| 2,138,825 | 12/1938 | Allen | 34/14 |
| 2,222,945 | 11/1940 | Groll, Jr. et al. | 44/6 |
| 2,278,413 | 4/1942 | Campbell | 44/6 |
| 2,338,634 | 1/1944 | Fuchs | 44/1 R |
| 2,422,132 | 12/1949 | Payne et al. | 34/13 |
| 2,844,886 | 7/1958 | Nathan | 34/10 |
| 2,854,347 | 9/1958 | Booth et al. | 44/6 |
| 3,250,016 | 5/1966 | Agarwal | 34/10 |
| 3,309,780 | 3/1967 | Goins | 34/10 |
| 3,723,079 | 3/1973 | Seitzer | 44/1 R |
| 3,985,516 | 10/1976 | Johnson et al. | 44/1 R |
| 3,985,517 | 10/1976 | Johnson | 44/1 R |
| 4,008,042 | 2/1977 | Auvil et al. | 34/13 |
| 4,169,321 | 10/1979 | Nichols | 34/23 |
| 4,201,657 | 5/1980 | Anderson et al. | 44/6 |
| 4,247,991 | 2/1981 | Mehta | 34/35 |
| 4,265,637 | 5/1981 | Anderson | 44/1 G |
| 4,275,668 | 6/1981 | Daman | 110/245 |
| 4,324,544 | 4/1982 | Blake | 432/14 |
| 4,331,445 | 5/1982 | Burns | 44/6 |
| 4,354,825 | 10/1982 | Fisher et al. | 432/14 |
| 4,396,394 | 8/1983 | Li et al. | 44/1 G |
| 4,396,395 | 8/1983 | Skinner et al. | 44/6 |
| 4,402,707 | 9/1983 | Wunderlich | 44/6 |
| 4,421,520 | 12/1983 | Matthews | 44/1 G |

*Primary Examiner*—John J. Camby

*Attorney, Agent, or Firm*—F. Lindsey Scott

[57] ABSTRACT

A method for producing a dried particulate coal fuel having a reduced tendency to spontaneously ignite from a low rank coal by drying the low rank coal in a fluidized bed, cooling the resulting dried coal in a fluidized bed cooler, separating coal particles smaller than about 80 Tyler Mesh from the cooled dried coal and treating the cooled dried coal with a deactivating fluid.

11 Claims, 1 Drawing Figure

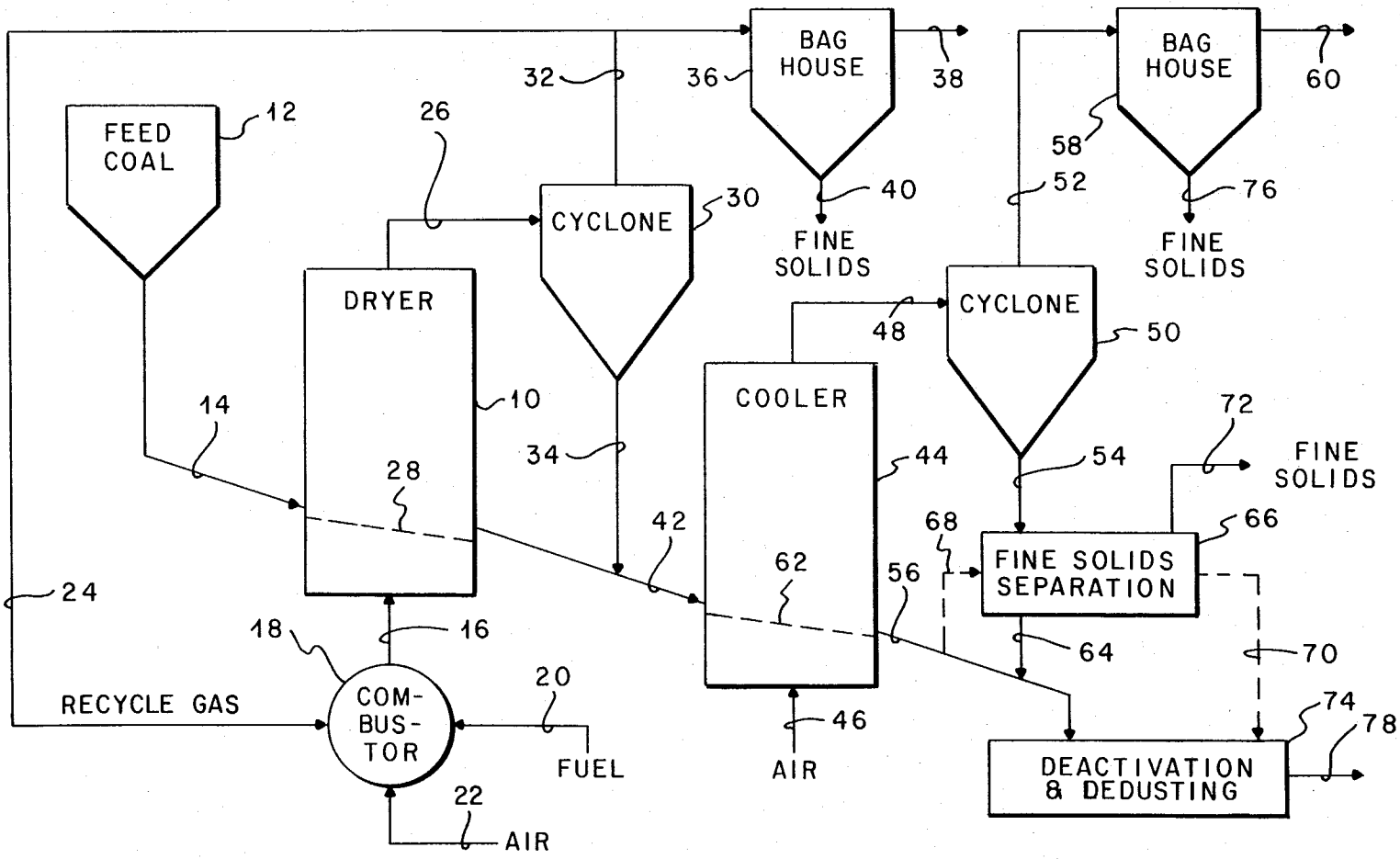
FEED COAL
DRYER
CYCLONE
BAG HOUSE
COOLER
CYCLONE
BAG HOUSE
FINE SOLIDS SEPARATION
DEACTIVATION & DEDUSTING
COM-BUS-TOR
FUEL
AIR
AIR
RECYCLE GAS
FINE SOLIDS
FINE SOLIDS
FINE SOLIDS
10
12
14
16
18
20
22
24
26
28
30
32
34
36
38
40
42
44
46
48
50
52
54
56
58
60
62
64
66
68
70
72
74
76
78

METHOD FOR PRODUCING A DRIED PARTICULATE COAL FUEL FROM A PARTICULATE LOW RANK COAL

This invention relates to a method for producing a dried particulate coal fuel from a particulate low rank coal.

This invention further relates to a method for producing a dried particulate coal fuel having a reduced tendency to spontaneously ignite from a particulate low rank coal.

This invention further relates to a method for producing a dried particulate coal fuel having a reduced dusting tendency from a particulate low rank coal.

This invention further relates to a method for producing a dried particulate coal fuel having a reduced tendency to spontaneously ignite and a reduced dusting tendency from a particulate low rank coal.

In many instances, coal as mined, contains undesirably high quantities of water for transportion and use as a fuel. This problem is common to all coals, although in higher rank coals such as anthracite and bituminous coals, the problem is less severe because the water content of the coal is normally lower and the heating value of such coals is higher. The situation is different with respect to lower rank coals such as sub-bituminous, lignite and brown coals. Such coals as produced typically contain from about 20 to about 65 weight percent water. While many such coals are desirable as fuels because of their relatively low mining cost and because of their relatively low sulfur content, the use of such lower rank coals as fuel has been greatly inhibited by the fact that as produced they typically contain a relatively high percentage of water. Attempts to dry such coals for use as a fuel have been inhibited by the tendency of such coals after drying to undergo spontaneous ignition and combustion in storage, transportation or the like. Further, the reactivity of the dried lower rank coal has resulted in handling problems in drying processes. In particular, when finely divided particles of dried lower rank coals are exposed to elevated temperatures and the like, they are very readily ignited and present explosion and fire hazards.

The drying required with lower rank coals is a deep drying process for the removal of surface water plus large quantities of inherent water present in the lower rank coals. By contrast, when higher grade coals are dried, the drying is commonly for the purpose of drying the surface water from the coal particle surfaces but not inherent water since the inherent water content of the higher rank coals is relatively low. As a result, short residence times in the drying zone are normally used and the interior portions of the coal particles are not heated since such is not necessary for surface drying. Normally the coal leaving the dryer in such surface water drying processes with higher rank coal is at a temperature below about 150° F. (about 65° C.) and more typically below about 110° F. (about 45° C.). By contrast, processes for the removal of inherent water require longer residence times and result in heating the interior portions of the coal particles. For instance, lower rank coal is typically retained in the drying zone at a temperature from about 170° to about 220° F. (about 75° to about 105° C.) for periods of time varying from about 3 to about 8 minutes in lower rank coal drying processes. As a result, the dried coal leaving a drying process for the removal of inherent water will typically be at a temperature from about 130° to about 220° F. (about 54° to about 105° C.). When such processes for the removal of inherent water are applied to lower rank coals, the resulting dried coal has a strong tendency to spontaneously ignite especially at the high discharge temperatures at which it leaves the dryer and also upon storage, during transportation and the like. In such processes for drying lower rank coal, a cooling step is normally used to reduce the temperature of the dried coal to a temperature below about 100° F. (about 38° C.), thereby reducing the reactivity of the dried coal. To further reduce the reactivity of the dried lower rank coal, deactivating agents may be used. Some suitable deactivating fluids are materials, such as oil, as disclosed in U.S. Pat. No. 4,402,707, issued Sept. 6, 1983 to Wunderlich entitled "Deactivating Dried Coal With a Special Oil Composition" and latex formulations as disclosed in U.S. Pat. No. 4,421,520 issued Dec. 20, 1983 to Matthews and entitled "Reducing the Tendency of Dried Coal to Spontaneously Ignite" (now U.S. Ser. No. 333,146, filed Dec. 21, 1981). These materials are used to reduce the tendency of the dried lower rank coal to spontaneously ignite upon storage, transportation or the like. Normally, a predetermined degree of deactivation is desired and the amount of deactivating fluid to be used is selected to accomplish this degree of deactivation. Further, such materials, particularly the oil, may be used to reduce the tendency of the dried lower rank coal to dust upon handling, etc.

While deactivation and dedusting are accomplished by the use of such materials, the cost of the deactivating fluids is high relative to the value of the dried particulate coal product. Since it is necessary from a practical point of view to control the tendency to spontaneously ignite and to reduce the dusting tendency to an acceptable level, continuing efforts have been directed to the development of methods for reducing the tendency of dried particulate lower rank coal to spontaneously ignite and to produce dust upon handling.

In the preparation of this application, the following U.S. patents were considered: U.S. Pat. Nos. 4,201,657; 2,338,634; 4,275,668; 4,324,544; 3,250,016; 3,723,079; 2,844,886; 3,985,517; 4,008,042; 1,886,633; 2,098,232; 3,985,516; 2,854,347; 2,222,945; 2,278,413; 2,138,825; 4,331,445; 4,247,991; 4,169,321; 3,309,780; 2,492,132; and 4,354,825. These references are hereby incorporated in their entirety by reference.

According to the present invention, a dried particulate coal fuel having a reduced tendency to spontaneously ignite and a reduced dusting tendency is produced from a particulate low rank coal by a method consisting essentially of: (a) charging the coal to a coal drying zone; (b) supporting a bed of the coal above a support means in the coal drying zone, the support means being adapted to the flow of hot fluidizing gas upwardly through the support means and the coal; (c) flowing hot fluidizing gas upwardly through the support means and the coal at a rate sufficient to fluidize the coal to dry the coal to a water content of less than about 14 weight percent water; (d) recovering dried coal from the coal drying zone; (e) cooling the dried coal to a temperature below about 100° F. in a coal cooling zone; (f) separating at least a major portion of the finely divided coal particles of a size less than about 80 Tyler Mesh from the dried coal; and (g) treating the dried coal with a deactivating fluid to reduce the tendency of the dried coal to spontaneously ignite.

FIG. 1 is a schematic diagram of a process embodying the present invention.

In the discussion of the FIGURE, the term "line" will be used to refer to conduits, conveyors and the like as commonly used for the transport of solids, liquids or gases.

In FIG. 1, particulate low rank coal is fed to a dryer 10 which includes a support 28 which is normally a grate or the like. A bed of fluidized particulate coal is at least partially fluidized above support 28 by hot fluidizing gas which is charged to dryer 10 through a line 16. Particulate low rank coal is fed to dryer 10 from a coal feeder 12 via a line 14. The temperature commonly used in the bed of fluidized coal in dryer 10 are from about 170° to about 220° F. (about 77° to about 105° C.). Residence times in dryer 10 from about 3 to about 8 minutes are typical. The hot fluidizing gas charged to dryer 10 through line 16 is produced in a combustor 18 by combusting fuel supplied through a line 20 with air supplied through a line 22. A recycle gas stream (line 24) comprising exhaust gas from dryer 10 is used to modify the temperature of the hot fluidizing gas in line 16. Exhaust gas is recovered from dryer 10 through a line 26 and passed to a cyclone 30 where fine particulate solids are removed from the exhaust gas stream and recovered through a line 34 with at least a portion of the overhead stream from cyclone 30 being passed through a line 32 to a baghouse 36 where additional fine solids are removed from the overhead stream via a line 40 with the cleaned gas being exhausted from baghouse 36 through a line 38. The fine solids recovered through line 34 are optionally combined with the dried coal product from dryer 10. The dried coal product is passed through a line 42 from dryer 10 to a cooler 44. The dried coal product is maintained in cooler 44 as a fluidized or semifluidized bed above a grate or support 62 by the flow of cooling air supplied through a line 46. Exhaust gas from cooler 44 is recovered through a line 48 and passed to a cyclone 50 where finely divided solids are separated from the exhaust gas stream and recovered through a line 54. The overhead gas from cyclone 50 is then passed through a line 52 to a baghouse 58 where fine solids are recovered via a line 76 from the overhead gas stream which is then exhausted from baghouse 58 through a line 60. Both the exhaust gas recovered from baghouse 36 through line 38 and the exhaust gas recovered from baghouse 58 through line 60 may require further treatment, etc. before exhausting to the atmosphere. Such treatments of exhaust gas streams for environmental or other purposes is not considered to comprise a part of the present invention.

The fine solids recovered through line 54 are passed to a fine solids separation zone 66 which may comprise an aerodynamic separation device such as an aerodynamic particle classifier or the like. Sieve screening could also be used but is considered to be less desirable. In fine solids separation zone 66, fine solids of a size less than about 80 Tyler Mesh are separated from the stream of fine solids from line 54 and recovered through a line 72. The remainder of the fine solids (i.e. larger than about 80 Tyler Mesh) recovered through line 54 are passed through a line 64 and combined with the cooled dried coal product from cooler 44 which is recovered through a line 56 and passed to a deactivation and dedusting zone 74. A dried, deactivated, dedusted coal product stream is recovered through a line 78. Optionally, in the event that at least a major portion of the fine solids are not removed from the dried coal in cooler 44 via the exhaust gas in line 48, the stream recovered through line 56 or any portion thereof may be passed through a line 68 (shown as a dashed line) to fine solids separation zone 66 where at least a major portion of fine solids smaller than about 80 Tyler Mesh are recovered. The cooled dried coal stream from which the solids smaller than about 80 Tyler Mesh have been removed is then passed through a line 70 (shown as a dashed line) to deactivation and dedusting zone 74.

In many instances, at least a major portion, and in most instances, at least 80 percent of the fine solids smaller than about 80 Tyler Mesh will be removed from the dried coal in cooler 44 by entrainment in the exhaust gas recovered through line 48. Normally larger solids will also be entrained and recovered in cyclone 50. The separation of the solids smaller than about 80 Tyler Mesh from the stream recovered from cyclone 50 through line 54 before combining the remaining entrained solids (i.e. larger than 80 Tyler Mesh) with the cooled dried coal product results in removal of a major portion and preferably at least about 80 percent of the fine solids less than about 80 Tyler Mesh from the dried coal product stream.

In many instances, it may be found that the removal of particulate solids less than about 100 Tyler Mesh in size is preferable. In such instances, the process is as discussed above except that the fine solids recovered via line 72 are smaller than 100 Tyler Mesh.

In the treatment of cooled dried particulate low rank coal, the amount of deactivating fluid required is approximately proportional to the surface area of the coal so treated. It has been found that when from about 3 to about 6 weight percent of the cooled dried coal is removed in the form of finely divided particulate solids of a size consist less than about 80 Tyler Mesh and preferably less than about 100 Tyler Mesh, roughly 50 percent of the total surface area of the dried particulate coal stream is removed. This results in a 50 percent reduction in the amount of deactivating fluid required. This is a substantial savings at a minimal cost since only a small portion of the coal product has been removed and since there is a need for fuel in the process in any event. In particular, at least a portion of the finely divided coal solids are readily usable as fuel in combustor 18. Even if not used in combustor 18, these solids can be processed by other techniques to form larger particles by processes such as pelletization and the like or otherwise used for other purposes. The net result of the removal of these fine solids is that the amount of deactivating fluid can be decreased by roughly 50 percent. As indicated previously, the cost of the deactivating fluid is a significant part of the total product cost when dried particulate coal fuel having a reduced tendency to spontaneously ignite is produced by drying particulate low rank coal.

Further quantities of deactivating fluids are used in some instances for dust control. In many instances, it has been found that additional quantities beyond that required to accomplish the desired reduction in the tendency to spontaneously ignite have been required for dust control. Since there are relatively stringent requirements in many areas upon the amount of dust pollution which can be tolerated as a result of coal handling operations, this is a significant consideration. Not only does the method of the present invention remove large quantities of fine solids which could contribute to the dust problem, but the amount of material required to treat the remaining product stream is reduced substantially. It is not to be assumed that the dust control accomplished by the method of the present invention results solely from the removal of a major portion of the fine solids from the dried coal product stream since not all fine solids will be removed in most instances. Rather the improvement results from the surprising and synergistic combination of the fine solids removal with the remaining process steps to produce a dried coal product stream which can be treated to reduce its tendency to spontaneously ignite and its tendency to produce dust upon handling using a substantially reduced quantity of deactivating fluid.

It is desirable that the fine solids removal step be downstream of the cooler since dried low rank coal is relatively friable and tends to produce finely divided particles by attrition and the like upon treatment in fluidized beds such as cooler 44. Further, in dryer 10, not only are finely divided solids produced by the attrition inherent in the operation of a fluidized bed, but the low rank coal in many instances tends to partly disintegrate upon drying. As a result, even if very small quantities of finely divided solids are present in the coal feed to dryer 10, it is common to find from about 3 to about 6 weight percent of the total dried coal stream in the form of finely divided solids smaller than about 80 Tyler Mesh after drying and cooling in such processes.

Such processes are known to those skilled in the art and have been shown for instance in U.S. Pat. No. 4,396,394, issued Aug. 2, 1983 to Li et al entitled "A Method For Producing A Dried Coal Fuel Having A Reduced Tendency To Spontaneously Ignite From A Low Rank Coal" and in U.S. Pat. No. 4,354,825 issued Oct. 19, 1982 to Fisher et al entitled "Method And Apparatus For Drying Coal", both of which are hereby incorporated in their entirety by reference. The method of the present invention is useful with a variety of such processes so long as dried low rank coal containing substantial quantities of finely divided solids is the product stream.

As indicated previously, the finely divided solids recovered from cyclone 30 and the solids larger than about 80 Tyler Mesh from cyclone 50 are optionally combined with the dried coal product stream in lines 42 and 56. In either case, these finely divided solids streams could be diverted to other uses or the like. In most such processes, it is believed that these streams will be recombined with the dried coal product stream in line 42 or with the cooled dried coal product stream in line 56 respectively. As discussed previously, it is anticipated that in many such processes the removal of the finely divided solids smaller than about 80 Tyler Mesh from the underflow stream from cyclone 50 will be sufficient to remove a desired quantity, i.e. in excess of about 80 weight percent of the minus 80 Tyler Mesh solids from the total coal product stream recovered through line 56. In the event that such is not the case because of low cooling air fluidization rates or the like, it is possible that the whole or portions of the product stream recovered through line 56 could be treated although it is preferred that only the underflow stream from cyclone 50 be treated.

The deactivation and dedusting steps will not be discussed in detail since various deactivation and dedusting processes involving treatment of the dried coal product with oil, latex or other deactivating agents which involve treating the dried cooled coal with deactivating fluids are known. The present invention is not dependent upon the particular method by which the deactivating fluid is applied or upon the particular type of deactivating fluid chosen. A suitable method and apparatus for such treatment of dried coal is disclosed in U.S. Pat. No. 4,396,395, issued Aug. 2, 1983 to Skinner et al entitled "Method and Apparatus for Contacting Particulate Coal and a Deactivating Fluid".

Having thus described the present invention by reference to certain of its preferred embodiments, it is noted that the embodiments described are illustrative rather than limiting in nature and that many variations and modifications of the present invention are possible. Many such variations and modifications may appear obvious and desirable to those skilled in the art based upon a review of the foregoing description of preferred embodiments.

Having thus described the invention, we claim:

1. A method for producing a dried particulate coal fuel having a reduced tendency to spontaneously ignite from a particulate low rank coal, said method consisting essentially of:

(a) charging said coal to a coal drying zone;

(b) supporting a bed of said coal above a support means in said coal drying zone, said support means being adapted to the flow of hot fluidizing gas upwardly through said support means and said coal;

(c) flowing hot fluidizing gas upwardly through said support means and said coal at a rate sufficient to fluidize said coal to dry said coal to a water content of less than about 14 weight percent water;

(d) recovering dried coal from said coal drying zone;

(e) cooling said dried coal to a temperature below about 100° F. in a coal cooling zone;

(f) separating at least a major portion of the finely divided coal particles of a size less than about 80 Tyler Mesh from said dried coal; and (g) treating said dried coal with a deactivating fluid to reduce the tendency of said dried coal to spontaneously ignite.

2. The method of claim 1 wherein said finely divided coal particles are of a size less than about 100 Tyler Mesh.

3. The method of claim 2 wherein at least about 80 percent of said finely divided coal particles are separated.

4. The method of claim 1 wherein said deactivating fluid is oil.

5. The method of claim 1 wherein said dried coal is treated with said deactivating fluid in an amount sufficient to reduce the dusting tendency of said dried coal.

6. The method of claim 1 wherein a major portion of said finely divided coal particles are separated from said dried coal in said coal cooling zone and wherein said separated finely divided coal particles are separated into a first portion of a size less than about 80 Tyler Mesh and a second portion of a size greater than about 80 Tyler Mesh with said second portion being added to said dried coal.

7. In a method for producing a dried particulate coal fuel having a reduced tendency to spontaneously ignite from a particulate low rank coal, said method consisting essentially of:

(a) charging said coal to a coal drying zone;

(b) supporting said coal above a support means in said coal drying zone, said support means being adapted to the flow of hot fluidizing gas upwardly through said support means and said coal;

(c) flowing hot fluidizing gas upwardly through said support means and said coal at a rate sufficient to fluidize said coal to dry said coal to a water content of less than about 14 weight percent water;

(d) recovering said coal from said coal drying zone;

(e) cooling said dried coal to a temperature below about 100° F. in a coal cooling zone and treating said dried coal with a deactivating fluid to reduce the tendency of said dried coal to spontaneously ignite, an improvement comprising separating at least a major portion of the finely divided coal particles of a size less than about 80 Tyler Mesh from said dried coal prior to treating said dried coal with said deactivating fluid.

8. The improvement of claim 7 wherein said finely divided particles are of a size less than about 100 Tyler Mesh.

9. The improvement of claim 7 wherein a major portion of said finely divided coal particles are separated from said dried coal in said coal cooling zone in a finely divided coal particle stream and wherein said finely divided coal particle stream is thereafter separated into a first portion of a size less than about 80 Tyler Mesh and a second portion greater than about 80 Tyler Mesh with said second portion being added to said dried coal.

10. The improvement of claim 7 wherein said deactivating fluid is oil.

11. The improvement of claim 7 wherein said dried coal is treated with said deactivating fluid in an amount sufficient to reduce the dusting tendency of said dried coal.

* * * * *